US010393472B1

(12) United States Patent
Wei

(10) Patent No.: US 10,393,472 B1
(45) Date of Patent: Aug. 27, 2019

(54) SHOOTING DEVICE OF TOY GUN

(71) Applicant: Ho-Sheng Wei, New Taipei (TW)

(72) Inventor: Ho-Sheng Wei, New Taipei (TW)

( * ) Notice: Subject to any disclaimer, the term of this patent is extended or adjusted under 35 U.S.C. 154(b) by 0 days.

(21) Appl. No.: 16/132,351

(22) Filed: Sep. 14, 2018

(51) Int. Cl.
*F41B 11/00* (2013.01)
*F41B 11/51* (2013.01)
*F41B 11/89* (2013.01)
*F41B 11/721* (2013.01)

(52) U.S. Cl.
CPC ..... *F41B 11/51* (2013.01); *F41B 11/721* (2013.01); *F41B 11/89* (2013.01)

(58) Field of Classification Search
CPC ..... F41B 11/00; F41B 11/51; F41B 11/55; F41B 11/62
See application file for complete search history.

(56) References Cited

U.S. PATENT DOCUMENTS

2003/0047175 A1* 3/2003 Farrell ..... F41A 11/06 124/76
2011/0120437 A1* 5/2011 Tippmann, Jr. ..... F41B 11/55 124/74
2015/0241164 A1* 8/2015 Hsu ..... F41B 11/55 124/51.1
2015/0300771 A1* 10/2015 Tseng ..... F41B 11/62 124/74
2019/0113305 A1* 4/2019 Johnson ..... F41B 11/70

* cited by examiner

*Primary Examiner* — J. Woodrow Eldred
(74) *Attorney, Agent, or Firm* — Chun-Ming Shih; HDLS IPR Services

(57) ABSTRACT

A shooting device (1) of a toy gun is provided. The gun body (10) has an air cylinder (11), a chamber base (12), a barrel (13), and a magazine (14). The chamber base (12) has an air chamber (120). The barrel (13) has a bullet passage (130). The magazine (14) is disposed at a side of the barrel (13). The triggering structure (20) has a slide assembly (21), a latch (22), and a trigger linkage (23). The slide assembly (21) pushes the bullets (2); the trigger (30) pushes against the trigger linkage (23) by an external force to move the next bullet back to the magazine (14) and seal the magazine (14). Therefore, the shooting device satisfying the users' requirements is provided.

10 Claims, 6 Drawing Sheets

SHOOTING DEVICE OF TOY GUN

BACKGROUND OF THE INVENTION

Field of the Invention

The present invention relates to a toy gun and in particular to a shooting device of a toy gun.

Description of Prior Art

The current toy gun which uses an air bottle as a power source to actuate bullets utilizes the air pressure generated by the air steel bottle to fire the bullets. Besides, a piercing pin is disposed correspondingly at the bottle mouth of the air steel bottle disposed in the gun body. When the air steel bottle is pushed into the gun body, the bottle mouth of the air steel bottle is pierced by the piercing pin and then the compressed air in the air steel bottle is released to provide the power to fire the plastic bullets.

However, when the compressed air in the above-mentioned air steel bottle enters the air chamber, the resulting firing power is usually insufficient. As a result, the bullets of larger size are particularly not suitable for a long-rang shooting due to inadequate firing power.

In view of this, the inventor pays special attention to research with the application of related theory and tries to improve and overcome the above disadvantages regarding the prior art, which becomes the improvement target of the inventor.

SUMMARY OF THE INVENTION

One objective of the present invention is to provide a shooting device of a toy gun, which is provided with a slide assembly, a latch, and a trigger linkage. The trigger can push against the trigger linkage by an external force to move the next bullet back to the magazine and seal the magazine. Also, the trigger pushes against the latch to release the slide assembly in order to provide sufficient shooting power.

To achieve the above objective, the present invention provides a shooting device of a toy gun, used to shoot bullets, comprising a gun body, a triggering structure, and a trigger. The gun body has an air cylinder, a chamber base connecting to the air cylinder, a barrel connecting to the chamber base, and a magazine receiving the bullets. The air cylinder has a receiving chamber to accommodate an air bottle. The chamber base has an air chamber communicating with the receiving chamber. The barrel has a bullet passage communicating with the air chamber and allowing the bullets to advance. The magazine communicates with the bullet passage and is disposed at a side of the barrel. The triggering structure is disposed the gun body and has a slide assembly driven by the air, a latch, and a trigger linkage. The slide assembly which is disposed movably between the air chamber and the bullet passage can push the bullets into the bullet passage. The latch which is disposed at a side of the slide assembly can latch the slide assembly. The trigger linkage which is disposed at a side of the magazine can load the bullets sequentially into the barrel. The trigger is pivoted on the gun body and is disposed between the latch and the trigger linkage. The trigger pushes against the trigger linkage by an external force to move the next bullet back to the magazine and seal the magazine. The trigger pushes against the latch to release the slide assembly.

Another objective of the present invention is to provide a shooting device of a toy gun, which changes the volume of the pressurized air in the air chamber by means of disposing a separating block in the air chamber to adjust the shooting power for the bullets.

Compared with the prior art, the shooting device of the toy gun of the present invention has a triggering structure disposed in the gun body in which the slide assembly is disposed movably between the air chamber and the bullet passage to push the bullets into the bullet passage, the latch disposed at a side of the slide assembly can latch the slide assembly, and the trigger linkage disposed at a side of the magazine can load the bullets sequentially into the barre. Thus, the trigger pushes against the trigger linkage by an external force to move the next bullet back to the magazine and seal the magazine; the trigger pushes against the latch to release the slide assembly. In this way, sufficient shooting power is obtained to enhance convenience and practicability of the present invention.

DETAILED DESCRIPTION OF THE INVENTION

The detailed description and technical details of the present invention will be explained below with reference to accompanying drawings. However, the accompanying figures are only for reference and explanation, but not to limit the scope of the present invention.

Figure 1:
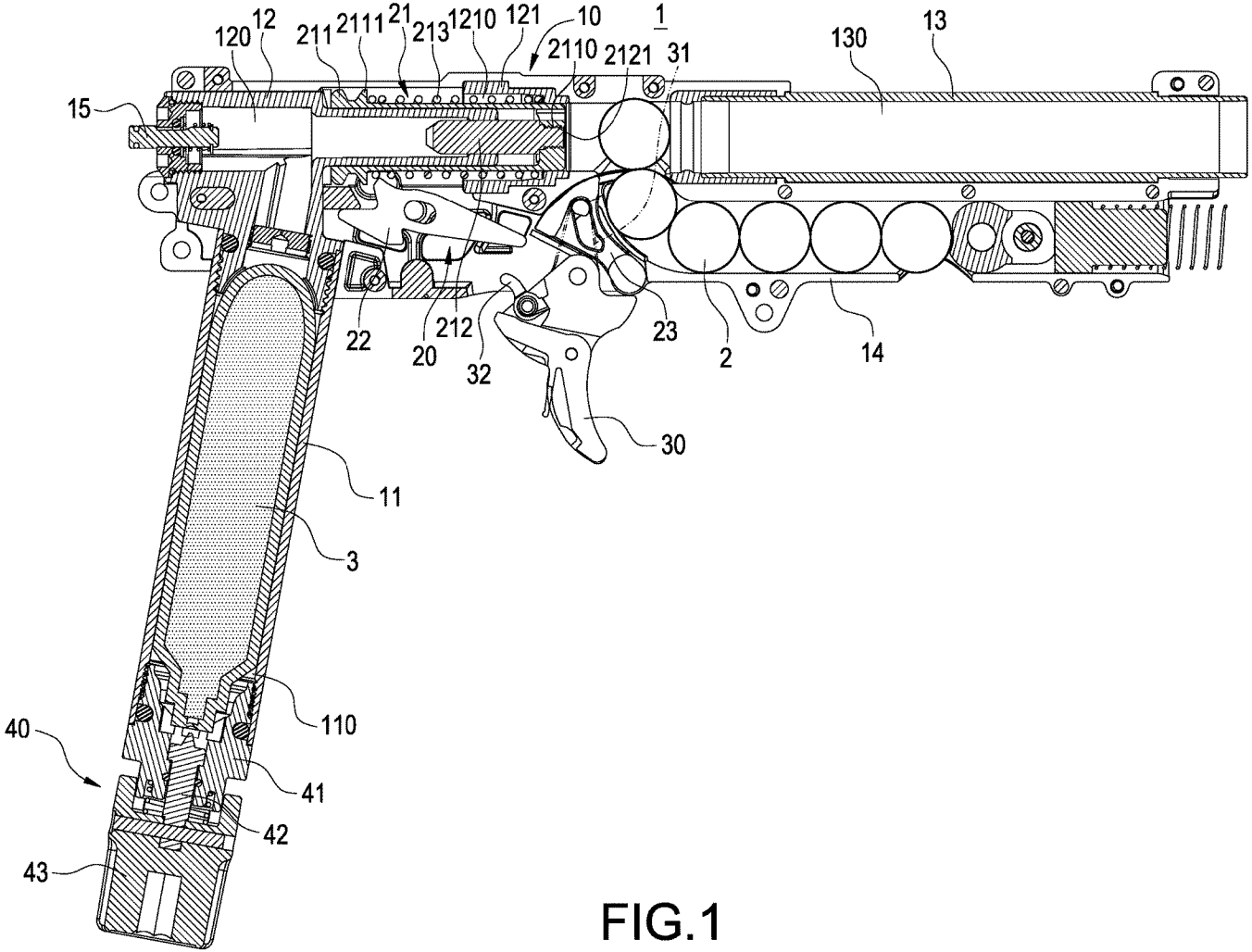
FIG. 1 is a cross-sectional view of the shooting device of a toy gun of the present invention.

Please refer to FIG. 1, which is a cross-sectional view of the shooting device of a toy gun of the present invention. The present invention relates to a shooting device 1 of a toy gun, used to shoot bullets 2. The shooting device 1 comprises a gun body 10, a triggering structure 20, and a trigger 30. The triggering structure 20 is assembled to the gun body 10 and shoots the bullets 2 through the control of the trigger 30. The detailed description of the shooting device 1 of the toy gun is given below.

The gun body 10 has an air cylinder 11, a chamber base 12 connecting to the air cylinder 11, a barrel 13 connecting to the chamber base 12, and a magazine 14 receiving the bullets 2. The air cylinder 11 has a receiving chamber 110 to accommodate an air bottle 3. The chamber base 12 has an air chamber 120 communicating with the receiving chamber 110. The barrel 13 has a bullet passage 130 communicating with the air chamber 120 and allowing the bullets 2 to advance. Besides, the magazine 14 communicates with the bullet passage 130 and is disposed at a side of the barrel 13.

Preferably, the gun body 10 further comprises an indicator 15. One end of the indicator 15 penetrates into the air chamber 120 and the other end of the indicator 15 is exposed out of the chamber base 12. Thus, when the air chamber 120 is full of the pressurized air, the indicator 15 is pushed by the air to protrude away from the chamber base 12 to indicate that the pressurized air exists in the air chamber 120.

The triggering structure 20 is disposed in the gun body 10. The triggering structure 20 has a slide assembly 21 driven by the air, a latch 22, and a trigger linkage 23. The slide assembly 21 is disposed movably between the air chamber 120 and the bullet passage 130 and can push the bullets 2 into the bullet passage 130. Also, the latch 22 is disposed at a side of the slide assembly 21 and can latch the slide assembly 21. The trigger linkage 23 is disposed at a side of the magazine 14 and can load the bullets 2 sequentially into the barrel 13.

In addition, the trigger 30 is pivoted on the gun body 10 and disposed between the latch 22 and the trigger linkage 23. The trigger 30 can push against the trigger linkage 23 by an external force to move the next bullet 2 back to the magazine 14 and seal the magazine 14. The trigger 30 pushes against the latch 22 to release the slide assembly 21.

In detail, the shooting device 1 further comprises an air bottle piercing structure 40 combined with the air cylinder 11. The air bottle piercing structure 40 has a plug cover 41, a piercing pin 42 disposed through the plug cover 41, and a press assembly 43 flexibly assembled to the plug cover 41. The press assembly 43 can move the piercing pin 42 by another external force to pierce the air bottle 3.

In particular, the slide assembly 21 comprises a push cylinder 211 sleeved around the air chamber 120, a loading rod 212 combined with the push cylinder 211, and a spring 213 surrounding the push cylinder 211. One end of the loading rod 212 is disposed into the air chamber 120 when the spring 213 is not compressed. In the current embodiment, one end of the push cylinder 211 forms a screw hole 2110. Besides, one end of the loading rod 212 is a thread section 2121 having a plurality of threads. The loading rod 212 is screwed in the screw hole 2110 through the thread section 2121 and combined in the push cylinder 211.

Moreover, the outer surface of the push cylinder 211 forms an annular wall 2111. A blocking piece 121 is disposed at the chamber base 12 corresponding to the spring 213. One end of the spring 213 presses against the annular wall 2111 and the other end of the spring 213 presses against the blocking piece 121. The loading rod 212 is pushed by the air to move the push cylinder 211 towards the barrel 13 to compress the spring 213. Preferably, the blocking piece 121 is provided with a stop groove 1210 corresponding to the spring 213. The spring 213 is received in the stop groove 1210 when compressed.

Figure 2:
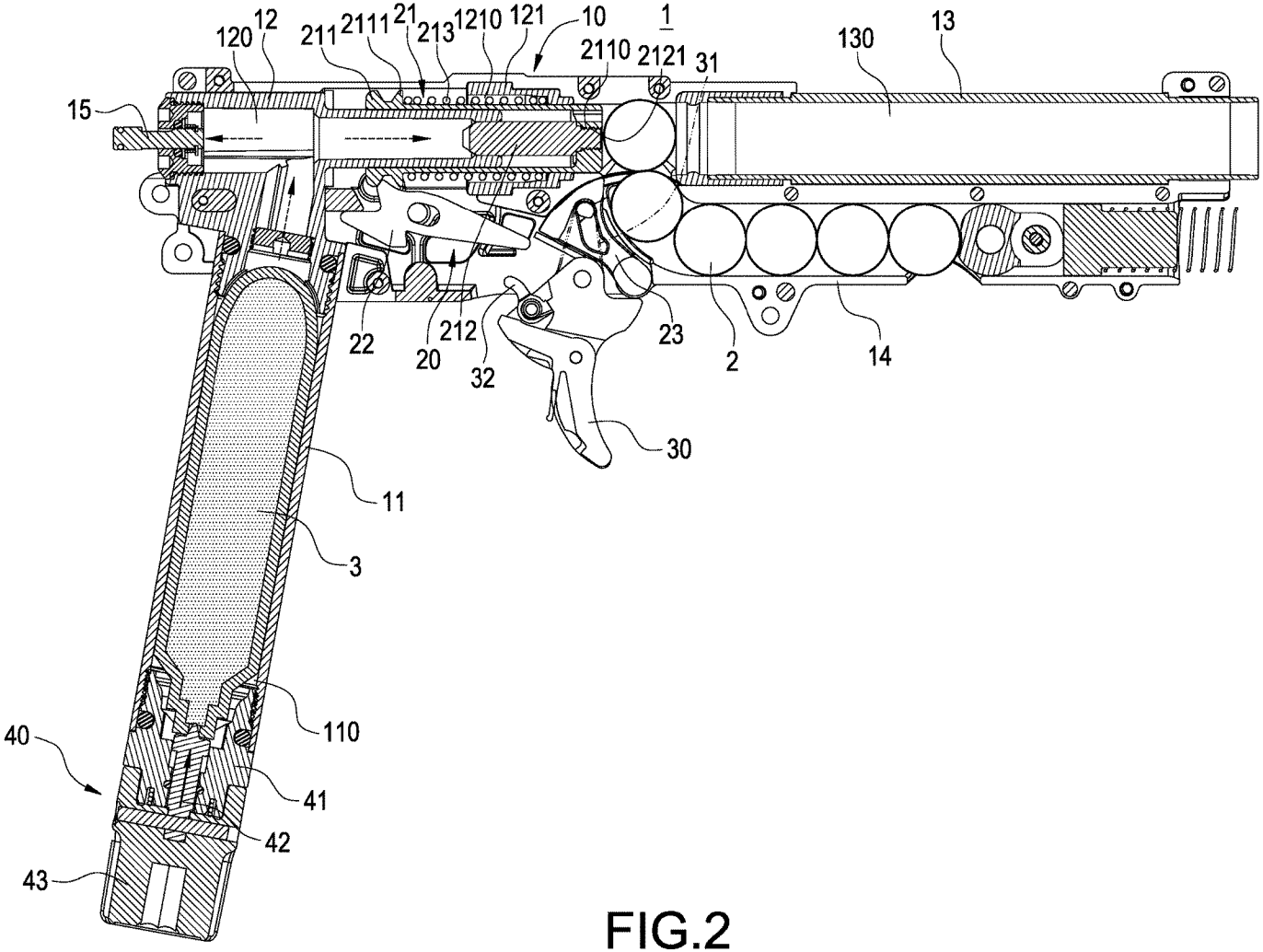
FIG. 2 is a schematic view of piercing the air bottle of the present invention.

Please continue to refer to FIG. 2, which is a schematic view of piercing the air bottle of the present invention. As shown in FIG. 2, in the current embodiment, the air bottle 3 is disposed inserted in the receiving chamber 110. When an external force is applied to the press assembly 43, the press assembly 43 will move the piercing pin 42 to pierce the air bottle 3. At this time, the air in the air bottle 3 is released and flows from the receiving chamber 110 to the air chamber 120 of the chamber base 12. It is worthy to note that the indicator 15 will be pushed by the air in the air chamber 120 to protrude away from the chamber base 12.

Figure 3:
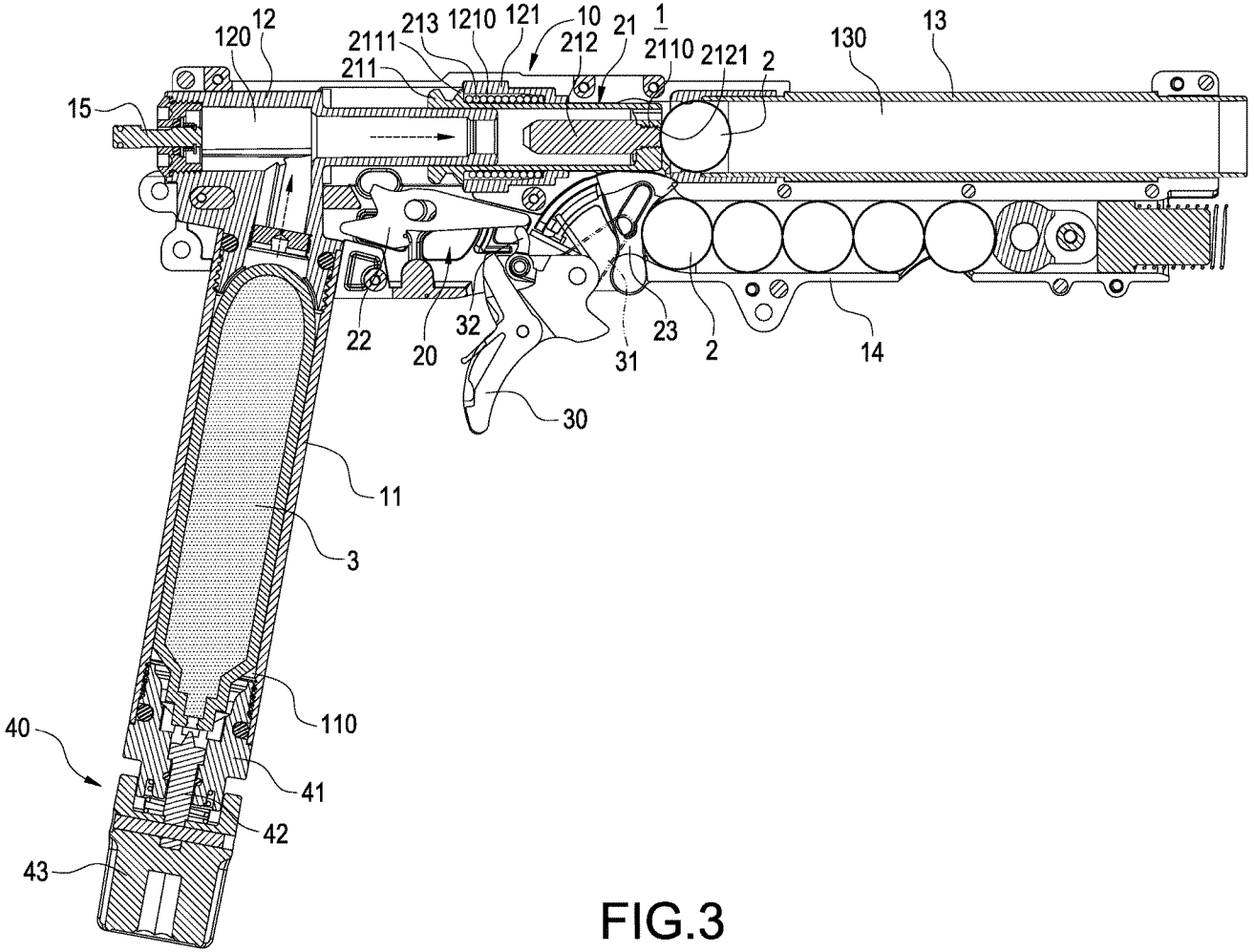
FIG. 3 is a schematic view of pressing against the trigger of the present invention.
Figure 4:
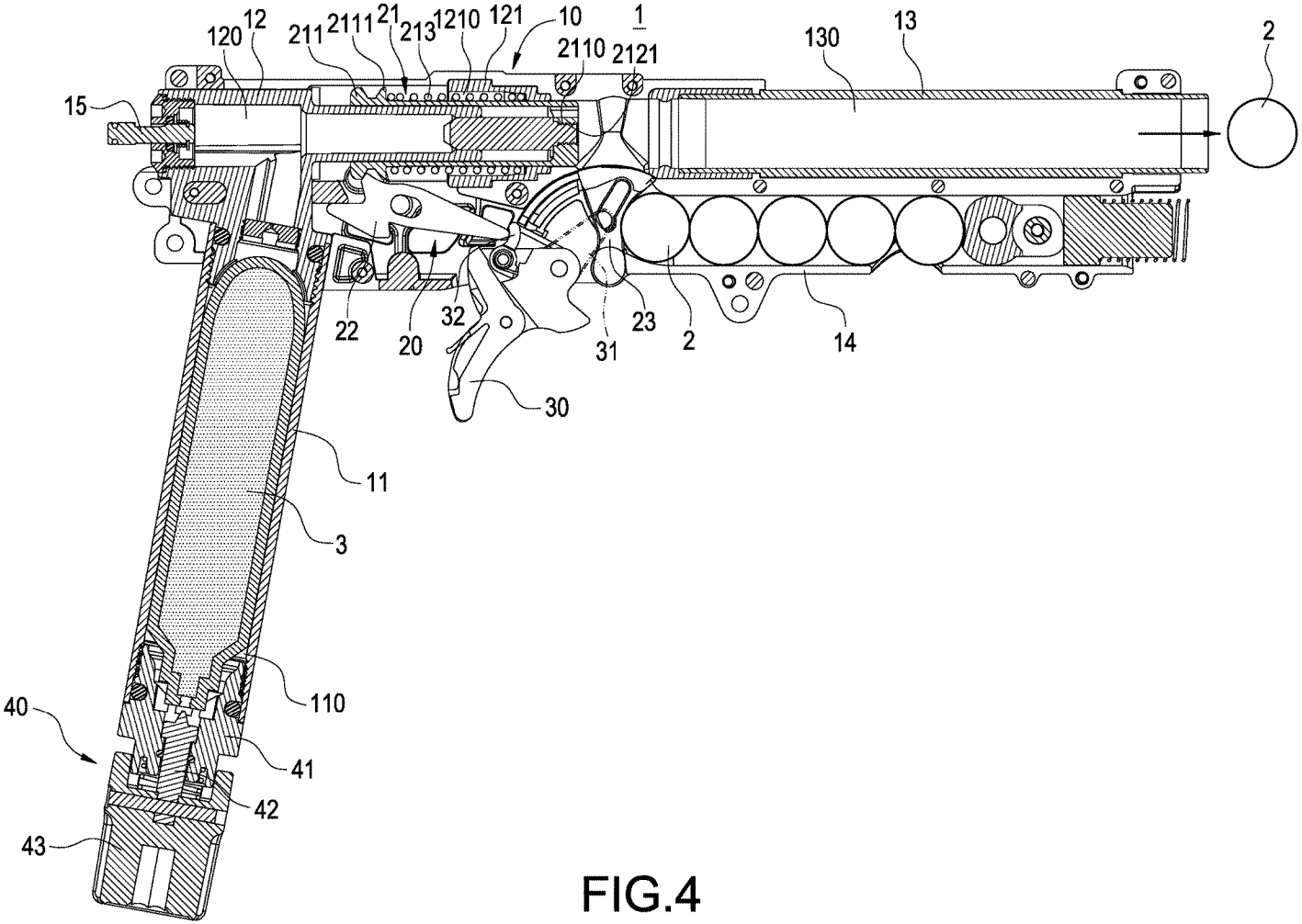
FIG. 4 is a schematic view of shooting the bullet of the present invention.

Please to refer to FIGS. 3 and 4 which are the schematic view of pressing against the trigger of the present invention and the schematic view of shooting the bullet of the present invention, respectively. In an embodiment of the present invention, the trigger 30 has a connecting part 31 and a protrusion 32. When the trigger 30 is pressed against by an applied external force, the trigger 30 and the connecting part 31 will move the trigger linkage 23 such that the trigger linkage 23 closes an end opening of the magazine 14 to prevent the compressed air in the air chamber 120 from flowing into the magazine 14. Please note that at this moment the trigger linkage 23 moves the next bullet 2 back to the magazine 14 simultaneously. Besides, the protrusion 32 presses against the latch 22 such that the latch 22 releases the latching of the slide assembly 21 to push the bullet 2 into the bullet passage 130 to shoot the bullet 2.

As shown in FIG. 4, after the bullet 2 is shot through the bullet passage 130, the push cylinder 211 and the loading rod 212 of the slide assembly 21 are replaced to the original position through the recovering force of the spring 213 to be latched again by the latch 22.

Figure 5:
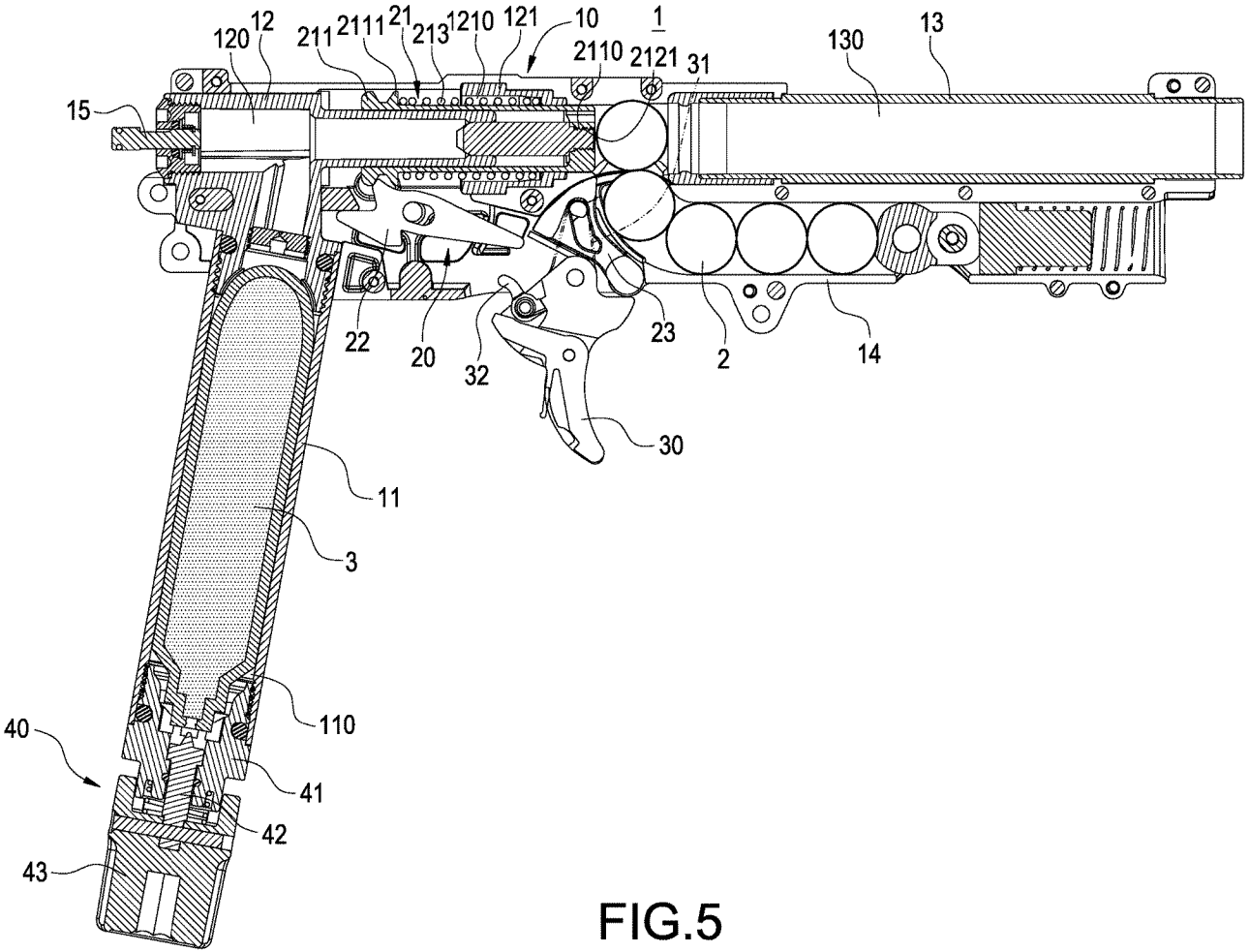
FIG. 5 is a schematic view of releasing the trigger of the present invention.

Please continue to refer to FIG. 5 which is a schematic view of releasing the trigger of the present invention. In the current embodiment, the trigger 30 moves back to the original position after the external force is removed to move the trigger linkage 23 away from the end opening of the magazine 14 such that the bullets 2 in the magazine 14 can enter the barrel 13 again and sequentially. In this way, the shooting device 1 of the toy gun can shoot the next bullet 1 in the magazine 14.

Figure 6:
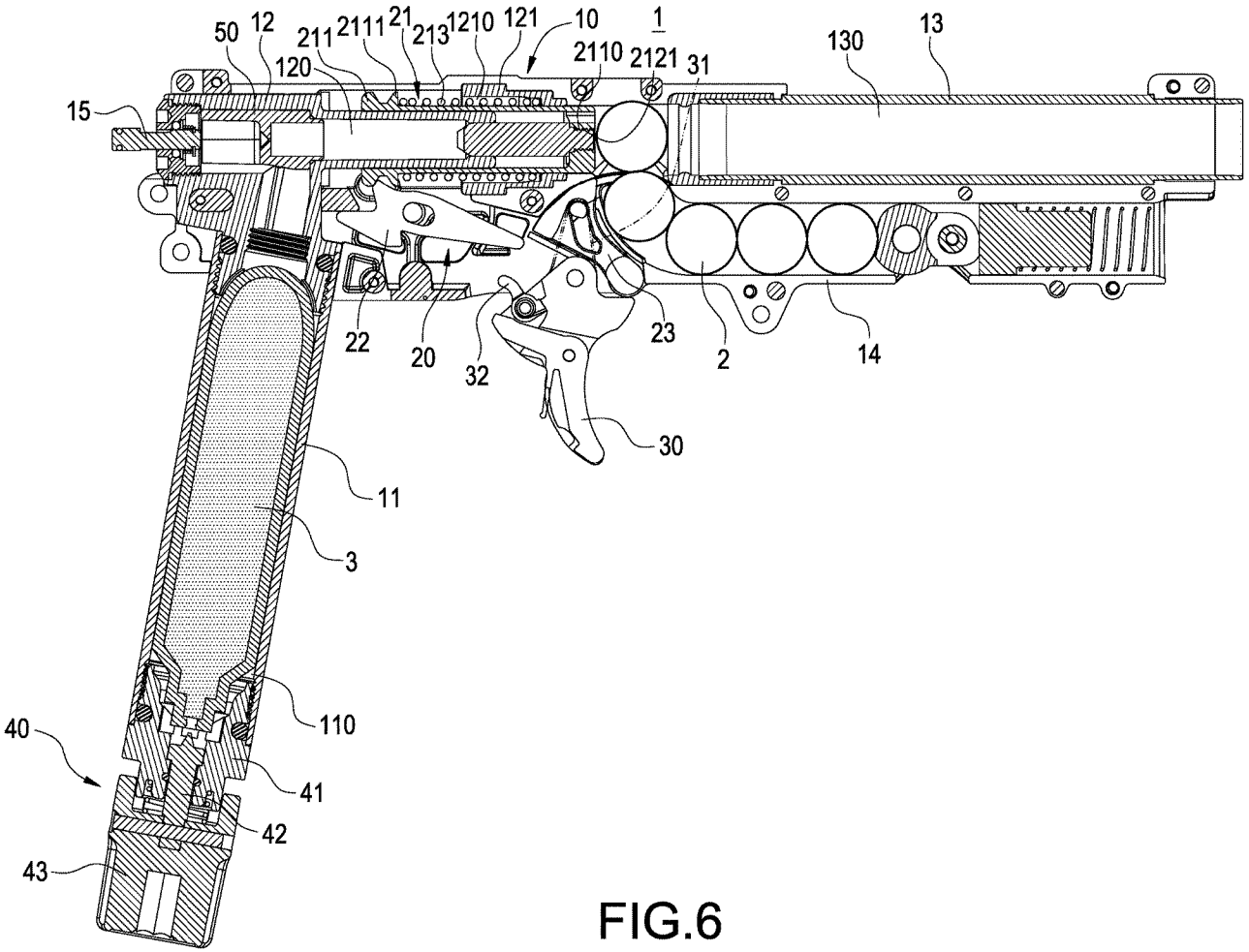
FIG. 6 is a cross-sectional view of the shooting device of a toy gun according to another embodiment of the present invention.

Please also refer to FIG. 6, which is a cross-sectional view of the shooting device of a toy gun according to another embodiment of the present invention. The current embodiment is roughly similar to the previous embodiment; the difference is that the shooting device 1 of the toy gun in the current embodiment further comprises a separating block 50. The separating block 50 is disposed in the air chamber 120; the space of the air chamber 120 can be adjusted through the disposition of the separating block 50. In this way, the user can dispose a separating block 50 in the air chamber 120 according to the practical requirements to further change the volume of the compressed air in the air chamber 120 to adjust the shooting power for the bullets 2.

The embodiments disclosed above are only preferred embodiments of the present invention, but not to limit the scope of the present invention. The scope of the present invention should be embraced by the accompanying claims and includes all the equivalent modifications and not be limited to the previous description.

What is claimed is:

1. A shooting device (1) of a toy gun, used to shoot bullets (2), comprising:

a gun body (10) having an air cylinder (11), a chamber base (12) connecting to the air cylinder (11), a barrel (13) connecting to the chamber base (12), and a magazine (14) receiving the bullets (2), wherein the air cylinder (11) has a receiving chamber (110) to accommodate an air bottle (3), wherein the chamber base (12) has an air chamber (120) communicating with the receiving chamber (110), wherein the barrel (13) has a bullet passage (130) communicating with the air chamber (120) and allowing the bullets (2) to advance, wherein the magazine (14) communicates with the bullet passage (130) and is disposed at a side of the barrel (13);

a triggering structure (20) disposed in the gun body (10) and having a slide assembly (21) driven by the air, a latch (22), and a trigger linkage (23), wherein the slide assembly (21) which is disposed movably between the air chamber (120) and the bullet passage (130) can push the bullets (2) into the bullet passage (130), wherein the latch (22) which is disposed at a side of the slide assembly (21) can latch the slide assembly (21), wherein the trigger linkage (23) which is disposed at a side of the magazine (14) can load the bullets (2) sequentially into the barrel (13); and a trigger (30) pivoted on the gun body (10) and disposed between the latch (22) and the trigger linkage (23), wherein the trigger (30) pushes against the trigger linkage (23) by an external force to move the next bullet (2) back to the magazine (14) and seal the magazine (14), wherein the trigger (30) pushes against the latch (22) to release the slide assembly (21).

2. The shooting device (1) of a toy gun according to claim 1, wherein the gun body (10) further comprises an indicator (15), wherein one end of the indicator (15) penetrates into the air chamber (120) and the other end of the indicator (15) is exposed out of the chamber base (12).

3. The shooting device (1) of a toy gun according to claim 1, further comprising an air bottle piercing structure (40) combined with the air cylinder (11), wherein the air bottle piercing structure (40) has a plug cover (41), a piercing pin (42) disposed through the plug cover (41), a press assembly (43) flexibly assembled to the plug cover (41), wherein the press assembly (43) can move the piercing pin (42) by another external force to pierce the air bottle (3).

4. The shooting device (1) of a toy gun according to claim 1, wherein the slide assembly (21) has a push cylinder (211) sleeved around the air chamber (120), a loading rod (212) combined with the push cylinder (211), a spring (213) surrounding the push cylinder (211), wherein one end of the loading rod (212) is disposed into the air chamber (120) when the spring (213) is not compressed.

5. The shooting device (1) of a toy gun according to claim 4, wherein the outer surface of the push cylinder (211) forms an annular wall (2111), wherein a blocking piece (121) is disposed at the chamber base (12) corresponding to the spring (213), wherein one end of the spring (213) presses against the annular wall (2111) and the other end of the spring (213) presses against the blocking piece (121), wherein the loading rod (212) is pushed by the air to move the push cylinder (211) towards the barrel (13) to compress the spring (213).

6. The shooting device (1) of a toy gun according to claim 5, wherein the blocking piece (121) is provided with a stop groove (1210) corresponding to the spring (213), wherein the spring (213) is received in the stop groove (1210) when compressed.

7. The shooting device (1) of a toy gun according to claim 4, wherein one end of the push cylinder (211) forms a screw hole (2110), wherein one end of the loading rod (212) is a thread section (2121) having a plurality of threads, wherein the loading rod (212) is screwed in the screw hole (2110) through the thread section (2121) and combined in the push cylinder (211).

8. The shooting device (1) of a toy gun according to claim 5, wherein the trigger (30) has a connecting part (31) and a protrusion (32), wherein the trigger (30) is pressed by the external force and moves the connecting part (31) and the trigger linkage (23) such that the trigger linkage (23) closes an end opening of the magazine (14), wherein the protrusion (32) presses against the latch (22) such that the latch (22) releases the latching of the slide assembly (21) which pushes the bullets (2) into the bullet passage (130).

9. The shooting device (1) of a toy gun according to claim 8, wherein the push cylinder (211) and the loading rod (212) are replaced to the original position through the recovering force of the spring (213) to be latched again by the latch (22), wherein the trigger (30) moves back to the original position after the external force is removed to move the trigger linkage (23) away from the end opening of the magazine (14) such that the bullets (2) in the magazine (14) can enter the barrel (13) sequentially.

10. The shooting device (1) of a toy gun according to claim 1, further comprising a separating block (50) disposed in the air chamber (120), wherein the space of the air chamber (120) can be adjusted through the disposition of the separating block (50).

* * * * *